US005117739A

United States Patent [19]

Maher et al.

[11] Patent Number: 5,117,739

[45] Date of Patent: Jun. 2, 1992

[54] FLUID DRIVEN MULTI-AXIS APPARATUS

[75] Inventors: Patrick F. Maher, Loves Park; David A. Tucker, Durand, both of Ill.

[73] Assignee: C & C Manufacturing, Inc., Rockford, Ill.

[21] Appl. No.: 598,387

[22] Filed: Oct. 15, 1990

[51] Int. Cl.[5] ..... F01B 21/00

[52] U.S. Cl. ..... 92/2; 92/61; 92/66; 92/117 R; 92/136; 92/59; 116/285; 74/479; 91/61

[58] Field of Search ..... 92/2, 5 R, 54, 61, 117 R, 92/66, 56, 76, 136, 58, 59, 128; 91/61; 116/227, 285 X, 281; 73/290 R, 307; 74/479 X; 414/783

[56] References Cited

U.S. PATENT DOCUMENTS

| | | | |
|---|---|---|---|
| De. 308,207 | 5/1990 | Burke | D15/7 |
| 477,621 | 6/1892 | Bulmer | 92/2 |
| 1,689,392 | 10/1928 | Katterjohn | 91/61 |
| 3,174,406 | 3/1965 | Hague et al. | 92/2 |
| 3,815,479 | 6/1974 | Thompson | 92/2 |
| 4,111,100 | 9/1978 | Boyer | 91/401 |
| 4,119,017 | 10/1978 | Nusbaumer et al. | 92/108 |
| 4,134,306 | 1/1979 | Grotness et al. | 74/29 |
| 4,186,911 | 2/1980 | Huet et al. | 92/2 |
| 4,202,644 | 5/1980 | Sousloff | 403/369 |
| 4,364,687 | 12/1982 | Adell | 403/370 |
| 4,391,357 | 7/1983 | Bindernagel et al. | 192/94 |
| 4,665,558 | 5/1987 | Burke | 414/753 |

FOREIGN PATENT DOCUMENTS

| | | | |
|---|---|---|---|
| 0200707 | 12/1982 | Japan | 92/2 |
| 0182552 | 2/1963 | Sweden | 92/136 |
| 0933424 | 8/1963 | United Kingdom | 92/136 |

OTHER PUBLICATIONS

PHD, Inc., Fort Wayne, Indiana, "PHD Multi-Motion Actuators Air or Hydraulic", 1986, pp. 1

PHD, Inc., Fort Wayne, Indiana, "PHD Air/Oil Tanden Multi-Motion Actuators 2000-8000 Series", pp. 4-13 & 3-15.

*Primary Examiner*—Thomas E. Denion

*Attorney, Agent, or Firm*—Sheridan Ross & McIntosh

[57] ABSTRACT

An apparatus (10) for providing rotary and linear motions, either simultaneously or separately. The apparatus (10) includes a rotary table assembly (14) that interconnects a rotary actuator assembly (12) and a power cylinder (18) or a comparable device. The rotary table assembly (14) includes a rotatable hub (16) to which the power cylinder (18) is mounted. Rotation of the hub (16) causes rotary motion of the entire power cylinder (18). Because of the interconnection between the rotary actuator assembly (12) and the power cylinder (18) using a rotary table assembly (14), a modular construction is provided whereby the power cylinder (18) can be positioned both vertically and laterally, depending upon the application or intended use of the apparatus (10). In one preferred embodiment, the rotary actuator assembly (12) converts linear movement to rotary motion using hydraulic oil to provide a smooth, adjustable control of the rotary shaft (32) of the rotary actuator assembly (12). Hydraulic oil is located in a reservoir unit that is connected contiguously adjacent to the tandem cylinders (82 and 84) of the rotary actuator assembly (12).

19 Claims, 6 Drawing Sheets

FLUID DRIVEN MULTI-AXIS APPARATUS

FIELD OF THE INVENTION

The present invention relates to a fluid-controlled apparatus for providing, simultaneously or separately, linear and rotary motion to a working member connected to the apparatus.

BACKGROUND OF THE INVENTION

Fluid driven systems have been previously devised for causing movement of a working member. It is common practice, for example, to manipulate a robot-like member by rotating it and/or moving it in a linear direction using pneumatic or hydraulic drive systems. An apparatus that uses pneumatics for rotary and linear motion is disclosed in Thompson U.S. Pat. No. 3,815,479, issued Jun. 11, 1974, and entitled "Compound Motion Fluid Actuator." This apparatus includes a rack gear and a rotary gear for converting linear motion to rotary motion. This rotary actuator is driven by means of fluid pressure whereby linear movement of the rack gear causes the rotary gear to rotate. A power cylinder is attached to the rotary actuator and includes a hollow piston rod that extends beyond the end of the cylinder. A guide rod telescopically fits into the hollow piston rod for controlling rotation while permitting linear movement of the piston. The guide rod is interconnected to the rotary gear so that rotary motion of the rotary gear is imparted to the guide rod. Because of this construction, the power cylinder can only be joined to the rotary actuator in one configuration, i.e., with the length of the power cylinder being substantially perpendicular to the length of the rotary actuator. There is no modular relationship between the rotary actuator and the power cylinder in that this actuator requires these two major components to be connected in only one way due to the relationship between the hollow piston rod, the guide rod and the rotary gear.

A further embodiment of an actuator apparatus that includes compound motion is apparently available through the Leen Company of Portland, Me. This apparatus is exemplified in Burke U.S. Design Pat. No. D308,207, May 29, 1990. With regard to the connection between the rotary actuator and the cylinder in this apparatus, a ball-spline sleeve is fixed to a pinion gear of the rotary actuator and a splined piston rod is provided in the ball-spline sleeve whereby the full stroke of the splined piston rod occurs with smooth, rolling linear movement. Additionally, the pinion gear is provided at one end of the rotary actuator so that direct drive is achieved close to the work being done. Like the compound actuator of the '479 patent, the rotary actuator and the cylinder can only be connected in one way.

With respect to mechanisms for coupling a rotating shaft to a machine element for imparting rotary motion to the element, such a mechanical unit is disclosed in Soussloff U.S. Pat. No. 4,202,644, issued May 13, 1980, and entitled "Mounting Device." The disclosed device interconnects the cylindrical bore of the machine element to be rotated and a rotary shaft. The device has axially displacable sleeves that expand/contract to simultaneously grip the rotary shaft and the bore. The device further includes an internally threaded nut whereby rotation thereof allows axial displacement of the sleeves.

With respect to another embodiment of a rotary actuator for converting linear motion to rotary motion, the named assignee of the '479 patent has devised an air/oil tandem actuator having two cylinders and two rack gears. A rotary gear is operably connected to each of the two rack gears whereby controlled movement of a first rack gear in a first linear direction causes the rotary gear to rotate in a clockwise direction, while the other of the two rack gears moves linearly in a second direction, opposite that of the first rack gear. Conversely, counterclockwise rotation of the rotary gear is achieved by controlled movement of the second rack gear in the first direction. Relatedly, controlled movement of the second rack gear causes desired rotary movement of the rotary gear and accompanying linear movement of the first rack gear. Such controlled movement is accomplished using pressurized air. To provide smoother control of the rotary motion, this apparatus also includes hydraulic oil contained in each of the two tandem cylinders. When the racks are moved by pressurized air and there is accompanying rotary motion of the rotary gear, the contained oil acts to smooth the movement of the rack gears and thus the rotary gear. A reservoir is in fluid communication with the oil contained in the tandem cylinders and serves to compensate for oil volume changes due to temperature variation and leakage thereof. This reservoir is spaced from the tandem cylinders and requires a header pressure. Because of the required header pressure, the output port formed in the reservoir must be positioned below the reservoir for proper operation.

SUMMARY OF THE INVENTION

The present invention includes a rotary actuator assembly for converting linear motion to rotary motion. The rotary motion is coupled to a power cylinder having a piston assembly. The coupling of the rotary motion is achieved by means of a rotary table assembly. Use of the rotary table assembly enables the present invention to achieve a modular construction whereby the power cylinder is able to be selectively located relative to a rotatable shaft of the rotary actuator assembly in one of at least two positions. More particularly, the power cylinder can be located in one of two positions, with the two positions being substantially 90° apart. This is accomplished by means of the attachment between the power cylinder and a hub of the rotary table assembly.

The rotary actuator assembly includes a rotary gear having a rotatable shaft connected thereto. The shaft is connected to a coupling device of the rotary table assembly. In the preferred embodiment, the coupling device is the device disclosed in the aforesaid U.S. Pat. No. 4,202,644.

The hub of the rotary table assembly has a bore which receives portions of the coupling device to connect the hub to the shaft driven by the rotary gear. Rotational motion of the hub is imparted to the power cylinder, which may be fastened to the hub by a plate interconnected to the power cylinder and the hub or by the end portion of the power cylinder itself. Consequently, rotational movement of the rotary gear causes rotation of the entire power cylinder, and not merely the piston assembly within the power cylinder.

In a first position, the attachment plate is fastened to the power cylinder at one end of the length thereof for attachment to the hub. In this arrangement, the longitudinal axis of the power cylinder is substantially coaxial to the longitudinal axis of the rotatable shaft of the rotary actuator assembly. Alternatively, in a second position, the plate is attached to the side or along the longitudinal extent of the power cylinder so that the second position is 90° from the first position.

In a preferred embodiment, the rotary actuator assembly includes tandem cylinders that are pneumatically driven and which contain a fluid such as hydraulic oil to cause smooth rotation of the rotary gear. In this embodiment, a hydraulic oil reservoir assembly is provided in communication with the two cylinders. The reservoir assembly includes a reservoir body, which is connected directly to the cylinders. Formed in the reservoir body are first and second cylinder passageways. The outlet ends of each of the two cylinder passageways are contiguously adjacent to the cylinders. Hydraulic oil is able to move directly between each cylinder and the reservoir body by means of the two cylinder passageways. Also formed in the reservoir body is a common passageway that interconnects the two cylinder passageways. The reservoir body also has a completely enclosed reservoir chamber for containing hydraulic oil. A reservoir port provides fluid communication between the chamber and the common passageway. First and second flow control cartridges are operably connected in the paths of the cylinder ports for use in controlling desired hydraulic oil movement during operation of the tandem cylinders. That is, when pressurized air is supplied to a first of the two tandem cylinders, the rack gear moves in response thereto and causes the hydraulic oil in the first cylinder to move in the cylinder port associated with that cylinder. Hydraulic oil moves past the flow control cartridge and into the common passageway and past the flow control cartridge associated with the second cylinder and into the cylinder passageway for the second cylinder. The oil then moves into the second cylinder causing its rack gear to move in a linear direction opposite to the movement of the first rack gear. To achieve opposite rotation of the rotary gear, pressurized air is applied to the other of the two cylinders and similar movement of hydraulic oil occurs.

Preferably also, the reservoir includes an oil indicator assembly, which includes a plunger, a pull ring connected to the plunger and a spring surrounding the plunger. The plunger extends into the reservoir chamber, while the pull ring is connected to the plunger and is positioned exteriorly of the reservoir body. As the hydraulic oil in the reservoir chamber decreases due to oil leakage in the apparatus, the plunger extends further into the reservoir chamber. At a predetermined amount of hydraulic oil loss, the pull ring rises or changes position to indicate the loss of the predetermined amount of oil so that one is aware that additional oil is required.

Based on the foregoing summary, a number of salient features of the present invention are readily discerned. An actuator is disclosed that achieves both rotary and linear motion of a power cylinder or like device. A rotary table assembly enables the invention to be modular in construction whereby the power cylinder can be readily attached/detached from the rotary actuator assembly. Because of this flexibility, the power cylinder can be arranged in two different positions. Consequently, depending upon the user's application, the power cylinder can be arranged relative to the rotary actuator assembly in the most advantageous configuration for achieving the desired work or objective. Unlike the prior art, there is no direct connection or internal communication between the rotary gear shaft and the piston of the power cylinder. With respect to the rotary actuator assembly, in one preferred embodiment, tandem cylinders are utilized that incorporate hydraulic oil to achieve highly smooth, fully adjustable speed control of the rotary gear shaft. The reservoir is directly connected to the cylinder tandem whereby the outlet ends of the passageways carrying the oil are directly connected to the two cylinders. By means of this arrangement, the apparatus can be mounted in any attitude with reduced concern that there will be any unwanted hydraulic oil backflow. Relatedly, the oil reservoir requires no air header pressure and is fully self-contained.

BRIEF DESCRIPTION OF THE DRAWINGS

For a more complete understanding of the present invention and for further advantages thereof, reference is now made to the following Detailed Description taken in conjunction with the accompanying Drawings, in which.

DETAILED DESCRIPTION

Figure 1:
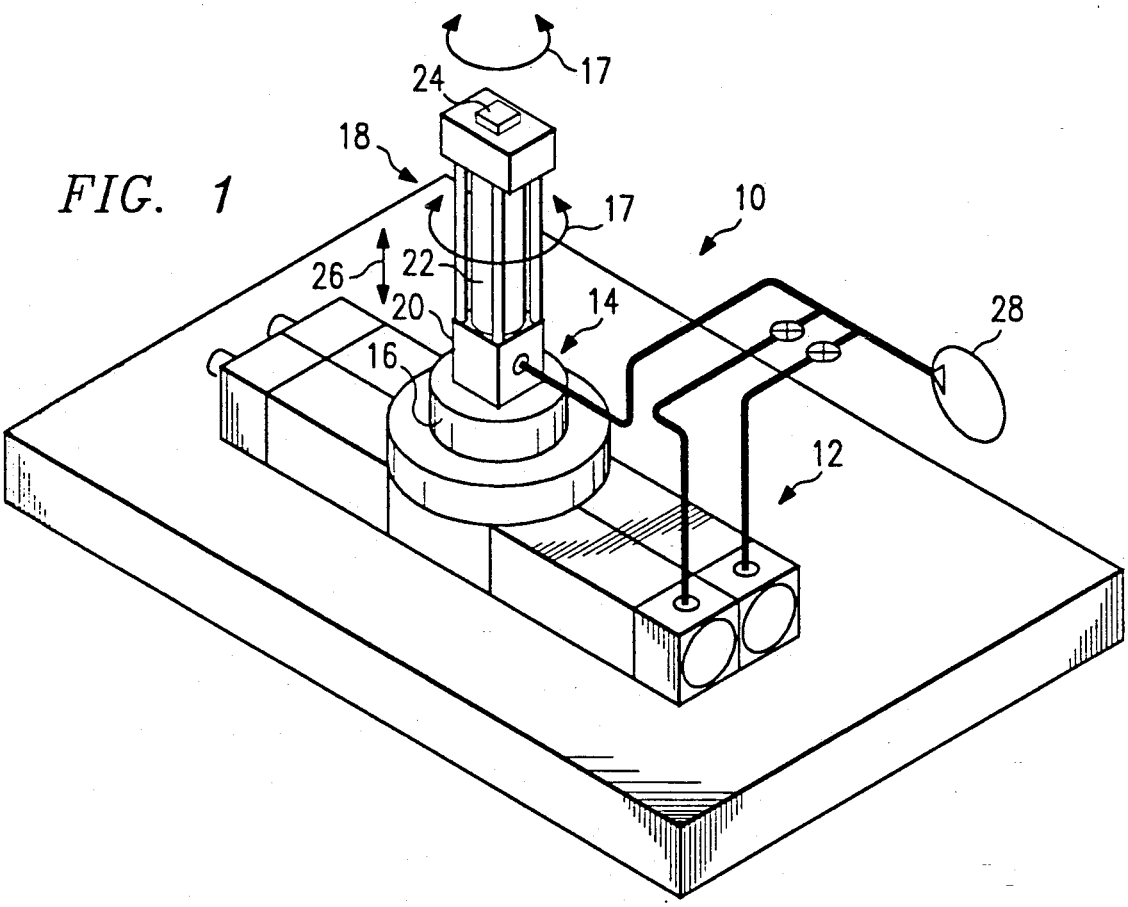
FIG. 1 is a perspective view of the present invention illustrating the tandem cylinder embodiment of the rotary actuator assembly connected to the power cylinder by means of the rotary table assembly.

In accordance with the present invention, a modular apparatus generally identified by the reference numeral 10 is provided in which a power cylinder or like device is able to output, simultaneously or separately, linear motion and rotary motion. With reference first to FIG. 1, the apparatus 10 includes a rotary actuator assembly 12 that is air driven to convert linear motion to rotary motion. The rotary actuator assembly 12 is operably connected to a rotary table assembly 14 that includes a rotatable hub 16. The rotary motion, as indicated by a double headed arrow 17, of the rotary actuator assembly 12 is coupled to the hub 16. The apparatus 10 also includes a power cylinder 18 or like device that receives the outputted rotary motion 17.

In the illustrated embodiment, the power cylinder 18 includes a plate 20 that connects the power cylinder 18 to the hub 16 of the rotary table assembly 14. Although not shown, it is to be understood that the power cylinder 18 may be directly connected to the hub 16 by an end portion thereof. In one embodiment, the power cylinder 18 is, by itself, a non-rotating unit that is caused to rotate by the motion coupled to it through the hub 16. The power cylinder 18 is a conventional and well-known unit and includes a movable piston assembly having two piston rods and a piston. The piston assembly is adapted to move a tooling plate 24 linearly and, with respect to FIG. 1, is able to move vertically up-and-down as indicated by a double headed arrow 26. Such vertical movement 26 is controlled using pressurized air (from a compressor 28) that passes through the cylinder wall 22 of the power cylinder 18 and creates a force on the piston therein for the desired movement 26 of the tooling plate 24 thereof.

Figure 2:
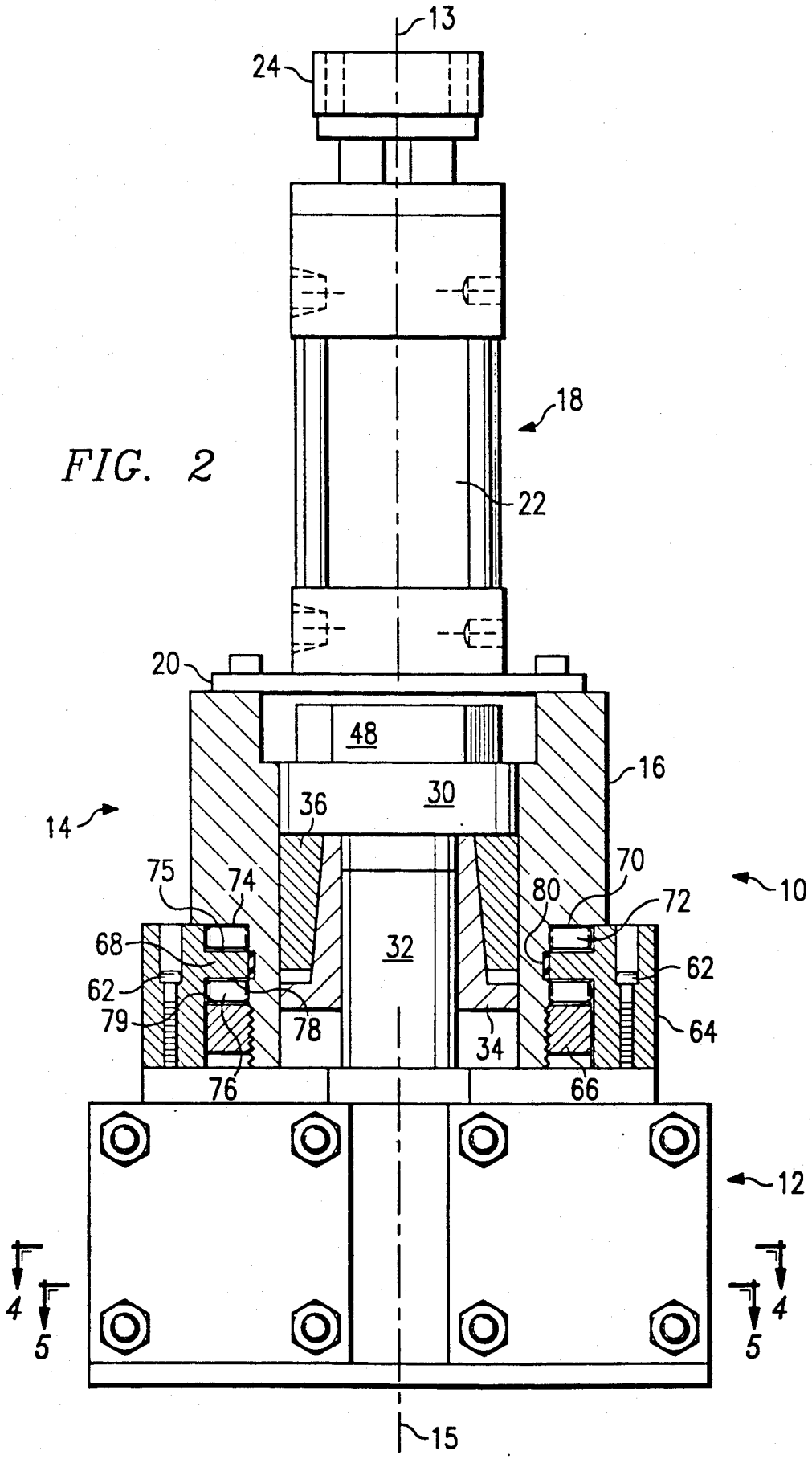
FIG. 2 is a longitudinal section illustrating the interconnection of the rotary actuator assembly and the power cylinder by means of the rotary table assembly with the rotary table assembly being illustrated in cross-section to show the component parts thereof.
Figure 3:
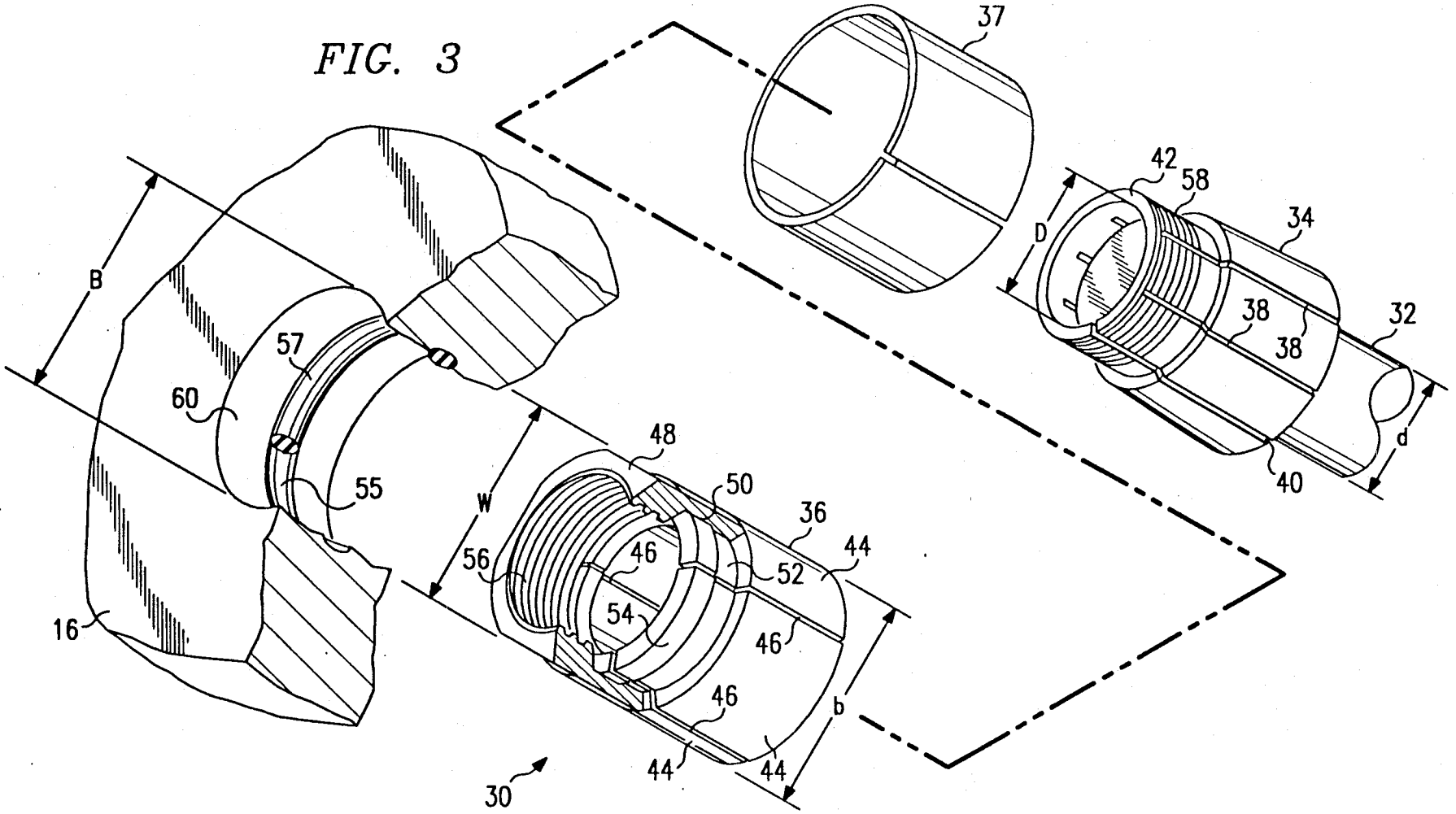
FIG. 3 is an enlarged, fragmentary, exploded view illustrating the coupling device for interconnecting the rotary gear shaft and the hub.

With reference to FIGS. 2 and 3, the rotary table assembly 14 is more fully described. The rotary table assembly 14 includes a trantorque coupler 30 which provides interconnection between the rotary actuator assembly 12 and the hub 16. A rotary shaft 32 is connected at one end to the rotary actuator assembly 12 for rotational movement, as will be subsequently described in greater detail, and at another end to the trantorque coupler 30. In the embodiment as shown in FIG. 2, longitudinal axis 13 through the cylinder 18 is generally coaxial with a longitudinal axis 15 of the rotary shaft 32.

The trantorque coupler 30, as best seen in FIG. 3, comprises a segmented inner sleeve 34 and a segmented outer sleeve 36. The inner sleeve 34 has an inside diameter D slightly larger than the outside diameter d of the rotary shaft 32 to allow repositioning thereof along the linear axis of the shaft 32. A plurality of cutouts 38 and one cutout 40 are formed in the segmented inner sleeve 34. The cutouts 38 and 40 allow the inner sleeve 34 to contract when engaged by the outer sleeve 36 around the rotary shaft 32. The cutout 40 is the only cutout on the inner sleeve 34 which does not terminate along a line spaced inwardly from an end 42 of the inner sleeve 34.

The outer sleeve 36 comprises a plurality of segments 44 each separated along lines 46. A hex nut 48 has an inner circumferential groove 50 for mating with an outer circumferential groove 52 and protrusion 54 on each of the segments 44. The hex nut 48 has internal threads 56 for receiving external threads 58 on the inner sleeve 34. The hex nut 48 has a width W which is slightly smaller than a diameter B of the hub 16. The outer sleeve 36 has an outer diameter b which is also slightly smaller than the diameter B of the hub 16. A split retainer ring 37 fits over the segments 44 of the outer sleeve 36 for contact with the bore 60 of the hub 16. The hub 16 has an inner circumferential glove 55 for receiving an "O"-ring 57 therein.

In operation, the retainer ring 37 is positioned over the outer sleeve 36. The inner sleeve 34 is threaded slightly into the hex nut 48 which is already mated with the outer sleeve 36. The assembled coupler 30 is then inserted into the bore 60 of the hub 16 which is retained therein by the "O"-ring 57 until the entire rotary table assembly 14 is ready for attachment to the rotary shaft 32 of the rotary actuator assembly 12. Upon attachment to the shaft 32, the hex nut 48 is then tightened onto the inner sleeve 34 causing the inner sleeve 34 to contract around and tightly hold the rotary shaft 32 and causing the outer sleeve 36 to expand into the ring 37 and tightly hold the hub 16. Therefore, any rotational movement of the rotary shaft 32 will be transmitted to the hub 16 through the inner sleeve 34, the outer sleeve 36 and the retainer ring 37 of the trantorque coupler 30.

The rotary table assembly 14 is attached to the rotary actuator assembly 12 by fasteners 62 such as for example, bolts through a housing 64. A lock nut 66 is held within the housing 64 by a circumferential flange 68 which is a part of the housing 64. The hub 16 is threaded into the lock nut 66 until a shoulder 70 thereof contacts a thrust washer 74 on the flange 68. A thrust bearing 72 is inserted between the thrust washer 74 and another thrust washer 75. Similarly, a thrust bearing 76 is installed between the lock nut 66 and the flange 68 with a thrust washer 78 and 79 positioned with the thrust bearing 76 therebetween. The bearings 72 and 76 and the washers 74, 75, 78 and 79 accept axial and radial loads applied to the rotary table assembly 14. A wear band 80 is installed between the hub 16 and the housing 64. Although not shown, it is to be understood that a grease fitting may be provided through the housing 64 to allow the application of a lubricant therein if necessary.

Figure 4:
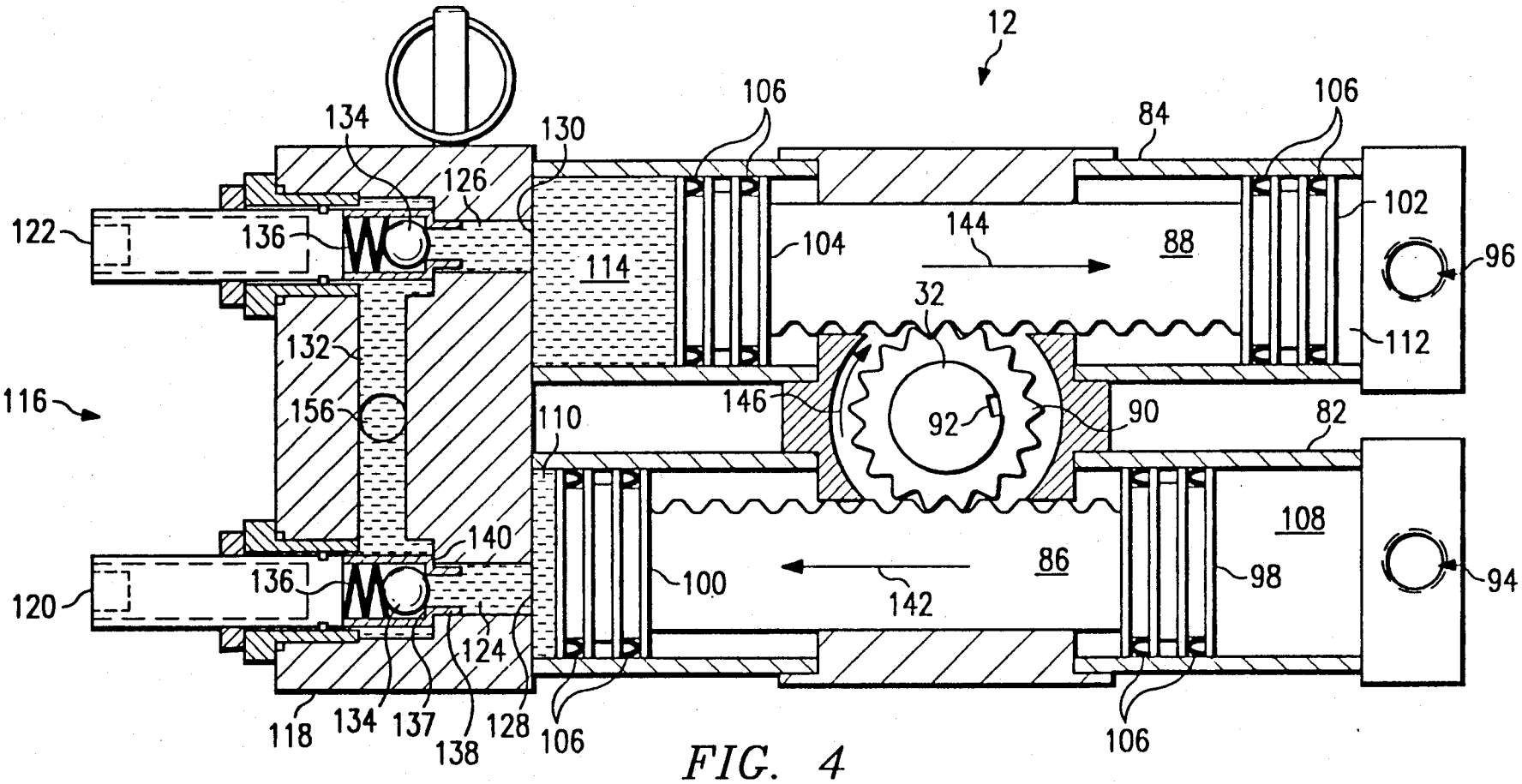
FIG. 4 is a longitudinal cross-sectional view along the line 4—4 of FIG. 2 of the tandem cylinders illustrating the interconnection between the reservoir and the cylinders and showing the hydraulic oil passageways.
Figure 5:
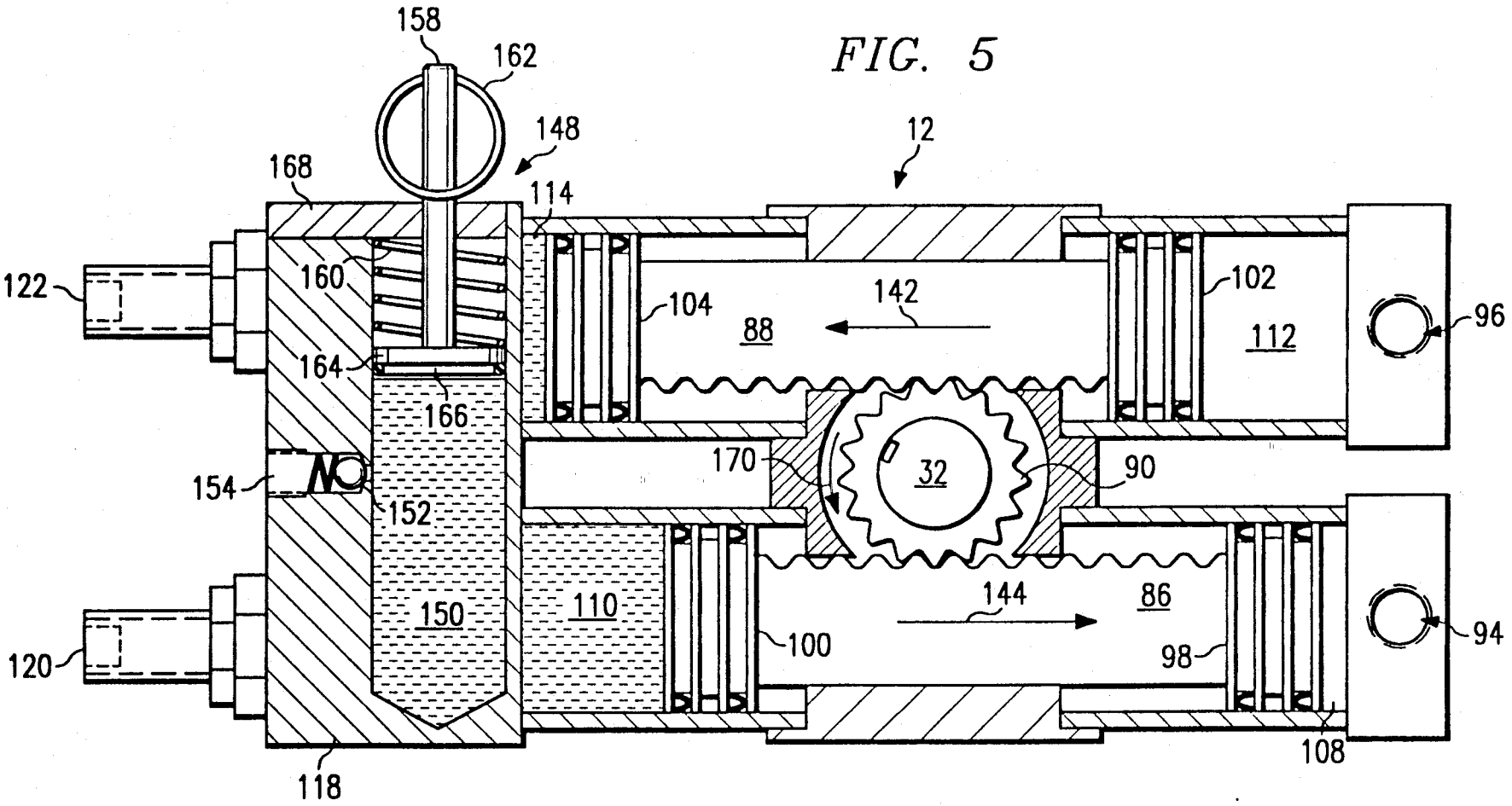
FIG. 5 is a longitudinal cross-sectional view along the line 4—4 and 5—5 of FIG. 2 of the tandem cylinders illustrating the reservoir chamber and the fluid level indicator.
Figure 6:
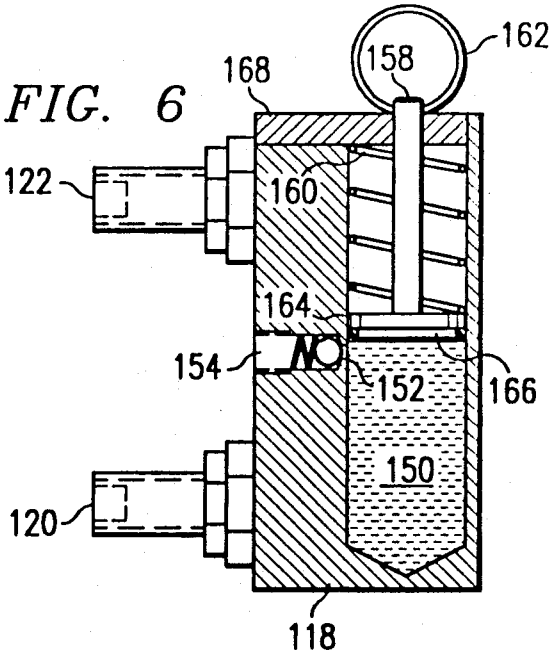
FIG. 6 is a cross-sectional view along the line 5—5 of FIG. 2 of the reservoir chamber in the signal position.

Referring to FIGS. 4, 5 and 6, the rotary actuator assembly 12 is shown in more detail. Referring first to FIG. 4, the rotary actuator assembly 12 comprises a first cylinder 82 and a second cylinder 84. The cylinders 82 and 84 contain rack gears 86 and 88, respectively, for transmitting linear motion therefrom to a rotary gear 90. The rotary shaft 32 is fit to the rotary gear 90 by any appropriate method such as a key 92. The cylinders 82 and 84 have inlet/outlet ports 94 and 96, respectively, for the introduction and release of air.

The first cylinder 82 has first piston 98 abutting and a second piston 100 affixed at opposite ends of the rack gear 86. The second cylinder 84 has first piston 102 abutting and a second piston 104 affixed at opposite ends of the rack gear 88. The pistons 98 through 104 are provided with appropriate seal rings 106 to form fluid tight chambers 108, 110, 112 and 114.

Affixed to the first and second cylinders 82 and 84 at ends opposite from the ports 94 and 96 is a hydraulic oil reservoir assembly 116. The assembly 116 comprises a reservoir body 118 and first and second flow control cartridges 120 and 122. Within the reservoir body 118, there are first and second cylinder passageways 124 and 126. The first and second cylinder passageways 124 and 126 are open at a first end 128 and 130, respectively, to the chambers 110 and 114. At opposite ends of the passageways 124 and 126 are the first and second flow control cartridges 120 and 122. Interconnecting the first and second flow cartridges 120 and 122 and the first and second cylinder passageways 124 and 126 is a common passageway 132.

The control cartridges 120–122 are threaded into the reservoir body 118 in order to provide control of the hydraulic oil therein. The cartridges 120–122 contain a ball 134 and spring 136 for flow control, as is well known in the art. For example, in the flow control cartridge 120, the spring 136 holds the ball 134 against a shoulder 138 to substantially prevent the flow of oil between the common passageway 132 and the first cylinder passageway 124. However, upon application of enough pressure to the hydraulic oil, the ball 134 will press the spring 136 to allow oil to flow from the first cylinder passageway 124 into the common passageway 132. Additionally, the cartridges 120 and 122 are adjustably inserted into the reservoir body 118 to provide passageways therearound. For example, the cartridge 120 is inserted to provide a gap between a leading portion 138 thereof and a shoulder 140 of the first cylinder passageway 124. Thus, oil may flow between the leading edge 138 and the shoulder 140 in either direction. Therefore, it is possible to adjust rotational speed of the rotary gear 82 and thus the rotary shaft 32 by positioning the cartridges 120 and 122 appropriately.

In operation, compressed air is forced through the inlet/outlet port 94 into the chamber 108. As the air enters the chamber 108, the piston 98 is forced in a direction indicated by an arrow 142. As the piston 98 moves in the direction 142, the rack gear 86 moves in the direction 142 and forces the piston 100 into the chamber 110. As the piston 100 moves into the chamber 110, hydraulic oil therein is forced into the first cylinder passageway 124 past the cartridge 120 and into the common passageway 132. From the common passageway 132, the hydraulic oil bypasses the cartridge 122 and enters the second cylinder passageway 126 and therefrom into the chamber 114. As the hydraulic oil is forced into the chamber 114, the piston 104 is forced in a direction indicated by an arrow 144. The movement of the piston 104 in the direction 144 causes the rack gear 88 to move in the direction 144 and thus the piston 102 moves in the direction 144. Thus, air is forced from the chamber 112 out the inlet/outlet port 96. The action just described results in a clockwise rotation as indicated by an arrow 146 of the rotary gear 90 and the rotary shaft 32. As a result of the use of hydraulic oil and compressed air, the movement of the rotary gear 90 is smooth and even.

Referring to FIG. 5, a cross-sectional view of the rotary actuator assembly along the same line 4—4 as FIG. 4 with a cross-sectional view of the reservoir body 118 along the line 5—5 of FIG. 2 is shown. In FIG. 5, an oil indicator assembly 148 and a reservoir chamber 150 are shown within the reservoir body 118. The reservoir chamber 150 further includes a reservoir port 152 for interconnection to the common passageway 132 (see FIG. 4). The reservoir port 152 is controlled by a ball valve 154 which allows controlled flow from the chamber 150 to the common passageway 132 via a reservoir passageway 156 (see FIG. 4). Although not shown, it is to be understood that the port 152 is further provided with a bleed capability to allow hydraulic oil to pass from the common passageway 132 back into the chamber 150.

The oil indicator assembly 148 comprises a plunger 158, a spring 160 and a pull ring 162. The pull ring 162 is pivotally attached to the plunger 158 to provide a signal that hydraulic oil in the chamber 150 is low, as will be subsequently described in greater detail. The plunger 158 is attached at an end opposite the ring 162 to a piston 164 having a piston ring 166 thereon. The plunger 158 passes through a plate 168 which is securely fastened to the reservoir body 118 by any appropriate method. Therefore, the spring 160 provides sufficient pressure against the piston 164 to appropriately pressurize the chamber 150 for passage of hydraulic oil therefrom.

Referring to FIG. 6, the reservoir chamber 150 is shown with the pull ring 162 in the low oil indicating condition. The plunger 158 is provided with a length appropriate to allow the piston 164 to reach a point slightly above the port 152. At this point, the pull ring 162 which was gradually pivoted from the vertical condition as shown in FIG. 5 to a vertical position 180° therefrom in FIG. 6. Thus, an operator knows that the chamber 150 needs to be refilled with hydraulic oil. Since the chamber 150 is entirely within the reservoir body 118 and no air is within the chamber 150 for pressure purposes, the rotary actuator assembly 12 may be oriented in any position without fear of hydraulic oil entering an air line as in the prior art.

Referring again to FIG. 5, operation of the rotary actuator assembly 12 in a direction opposite that of FIG. 4 is illustrated. As compressed air enters the chamber 112 through the port 96, the piston 102 is forced in the direction 142. As the piston 102 moves in the direction 142, the rack gear 88 and the piston 104 also move in the direction 142. Thus, the hydraulic oil in the chamber 114 is forced into the passageway 126 and through and around the cartridge 122 into the common passageway 132 (see FIG. 4). From the common passageway 132, the oil passes around the cartridge 120 into the passageway 132 and thus into the chamber 110. The oil entering the chamber 110 forces the piston 100, the rack gear 86 and the piston 98 in the direction 144. Air within the chamber 108 is then forced out of the port 94. Therefore, the rotary gear 90 is rotated in a counterclockwise direction as indicated by an arrow 170.

As previously described above with reference to FIG. 4, the flow control cartridges 120 and 122 allow a full control of the speed of rotation of the rotary gear 90. By opening or closing the gap between the cartridges 120 or 122 and the respective passageways 124 and 126, the speed at which hydraulic oil can flow is controlled or metered. The wider the gap therebetween, the faster oil may flow thereby, and the faster the appropriate rack gear may move linearly and thus the faster the rotary gear 90 is rotated. Obviously, it is possible to have the gaps between the cartridges 120 and 122 in their respective passageways to be set differently to provide different speeds of rotation in either the clockwise or the counterclockwise direction. Thus, not only does the rotary actuator 12 provide a smooth rotation of the rotary gear 90, but it also provides a fully controllable rotation speed as well as the ability to be positioned in any orientation.

Figure 7:
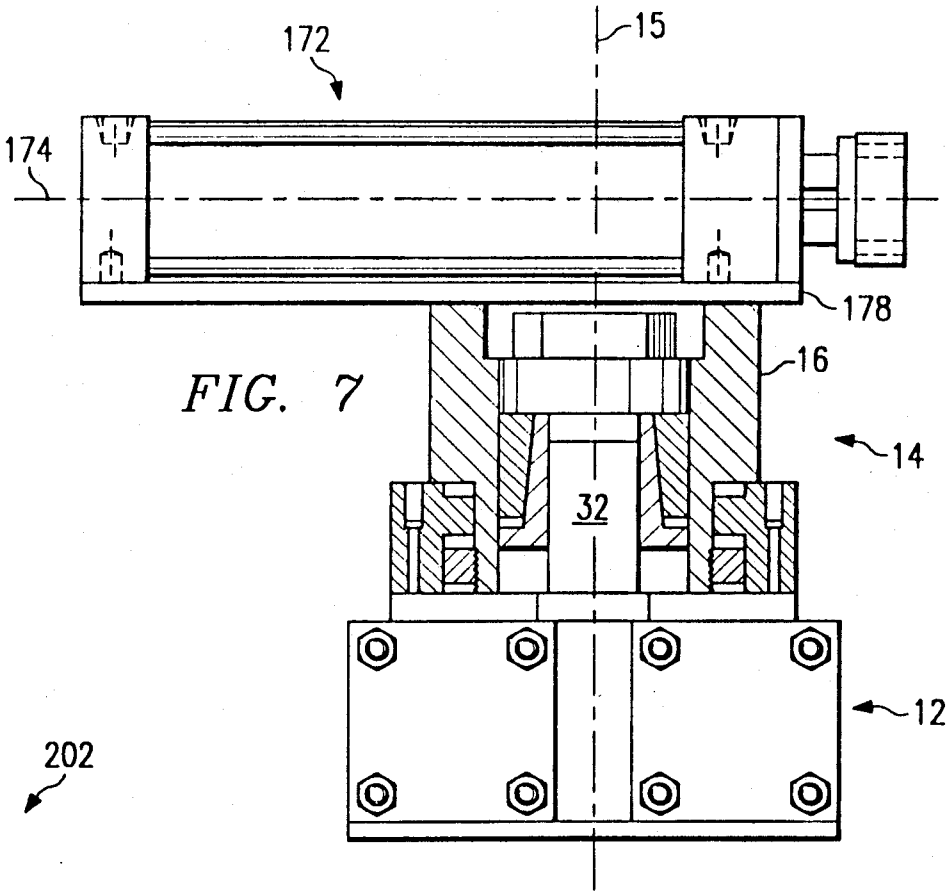
FIG. 7 is a longitudinal section illustrating the power cylinder extending laterally relative to the length of the rotary actuator assembly and at a position 90° from the position of FIG. 2.

Referring to FIG. 7, an alternative arrangement utilizing the rotary table assembly 14 of the present invention is illustrated. In the embodiment of FIG. 7, a power cylinder 172 is positioned on the rotatable hub 16 with its longitudinal axis 174 being substantially perpendicular to the longitudinal axis 15 of the rotary shaft 32. Therefore, the orientation of the cylinder 172 is approximately 90° from the orientation of the cylinder 18 as shown in FIG. 1 and FIG. 2. A plate 178 is fixed to a side of the cylinder 172 and to the hub 16. Thus, rotation of the rotary shaft 32 by the rotary actuator assembly 12 causes rotation of the cylinder 172 in a horizontal plane containing the axis 174 and being perpendicular to the plane of the paper of FIG. 7.

Thus, due to the rotary table assembly 14, the orientation of a power cylinder may be varied between at least two positions. The first position as shown in FIGS. 1 and 2 places the longitudinal axis 13 of the power cylinder 18 generally coaxial with the longitudinal axis 15 of the rotary shaft 32. The second position, approximately 90° from the first position, places the longitudinal axis 174 of the cylinder 172 generally perpendicular to the axis 15 of the shaft 32. Therefore, rotational movement may be imparted to a linear movement device in various configurations for more flexibility than in the prior art devices.

Figure 8:
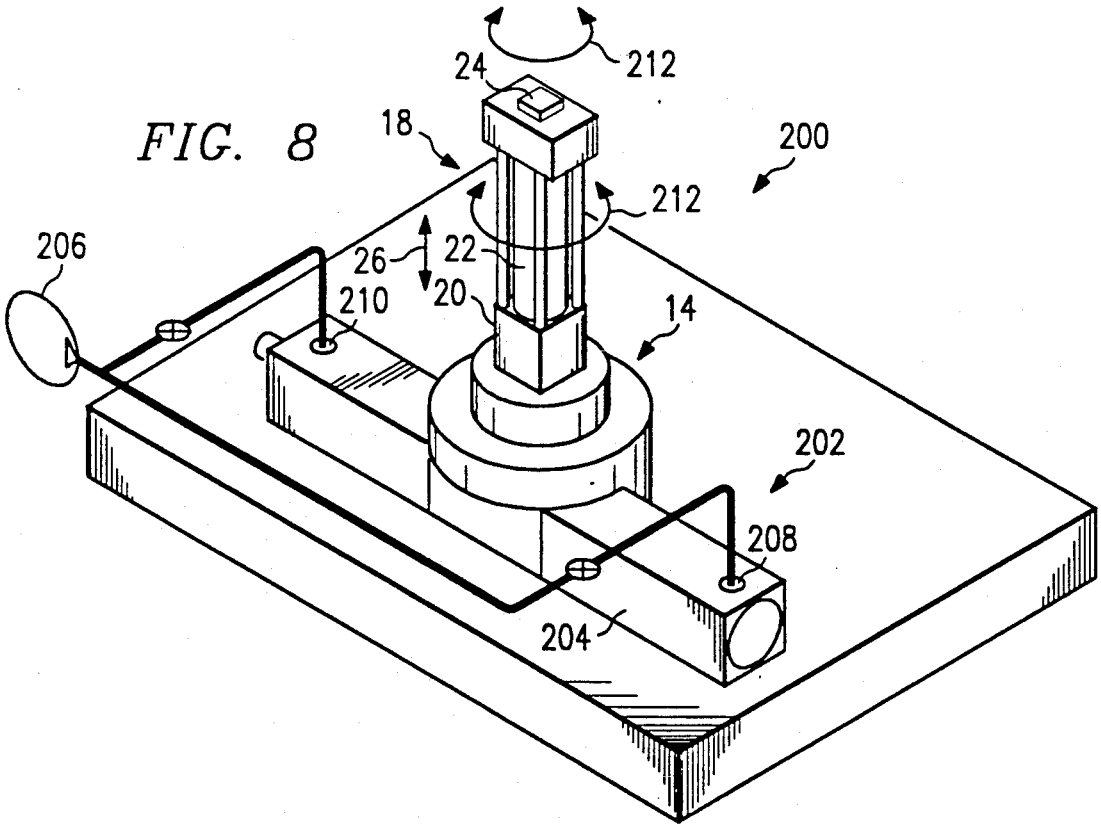
FIG. 8 is a perspective view of another embodiment of the present invention in which the rotary actuator assembly includes a single cylinder.

Referring to FIG. 8, an alternative embodiment of the modular apparatus 10 is generally identified by the reference numeral 200. In the embodiment of FIG. 8, a rotary actuator assembly 202 comprises a single pneumatic cylinder 204 as is known in the art. Air is provided to opposite ends of the cylinder 204 from a compressor 206 through inlet/outlet ports 208 and 210. As the cylinder 204 provides rotary motion as indicated by double headed arrow 212 to the rotary table assembly 14, the power cylinder 18 is similarly rotated. The apparatus 200 provides up-and-down motion in a direction 26 through action of the power cylinder 18 as previously described above. Although not shown, it is to be understood that the power cylinder 18 may be oriented 90° to the position shown in FIG. 8 similarly to the cylinder 172 as described above with reference to FIG. 7.

Figure 9:
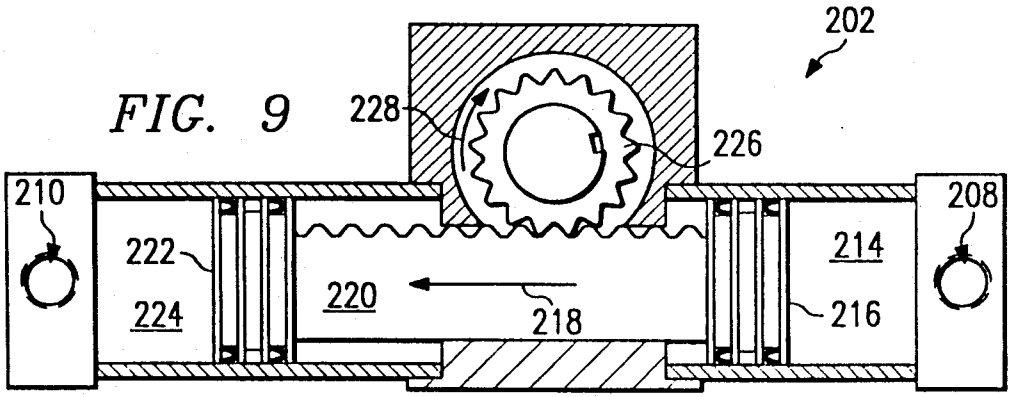
FIG. 9 is a longitudinal cross-sectional view of the rotary actuator assembly of FIG. 8 having the single cylinder.

Referring to FIG. 9, a cross-sectional view of the rotary actuator assembly 202 is shown. As air is forced into a first chamber 214 through the port 208, a piston 216 is forced in a direction indicated by an arrow 218. A rack gear 220 attached at one end to the piston 216 and at another end to a piston 222 is thus forced in the direction 218 pushing air from a chamber 224 out the port 210. The movement of the rack gear 220 in a direction 218 thus causes a rotational movement of a rotary gear 226 in a clockwise direction as indicated by an arrow 228 due to the meshing therebetween. By forcing air into the chamber 224 through the port 210 and allowing air to escape from the chamber 214 through the port 208, an opposite rotation from the direction 228 of the rotary gear 226 is possible. Thus, the assembly 202 provides rotary motion in two directions to the rotary table assembly 14.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best modes presently known of practicing the invention and to enable others skilled in the art to utilize the invention in such, or other embodiments, and with various modifications required by their particular applications or uses of the invention. It is intended that the appended claims be construed to include alternative embodiments to the extent permitted by the prior art.

What is claimed is:

1. A multi-axis apparatus, comprising:

rotary actuator means for providing rotary motion, said actuator means comprising a rotary gear and a rotary shaft attached thereto;

cylinder means for providing a linear motion including a linearly movable piston in a cylinder body, wherein said cylinder means by itself is not able to rotate; and rotary table means for connecting said rotary actuator means and said cylinder means, said rotary table means comprising a rotatable hub having a central bore therethrough and means for coupling which is attachable externally to said rotary shaft and internally to said central bore of said rotatable hub, said means for coupling transferring said rotary motion to said hub from said rotary actuator means, wherein substantially all of said cylinder means, including said piston and said cylinder body rotate and in which said rotary table means interconnects said cylinder means to said rotary actuator means in a selected one of two positions wherein, in a second position, a longitudinal axis of said cylinder means is substantially 90° different from said axis of said cylinder means in a first position.

2. An apparatus, as claimed in claim 1, wherein:

said rotary table means includes a housing connected to said rotary actuator means, said housing being non-rotatable.

3. An apparatus, as claimed in claim 2, wherein:

said rotary table means includes fastener means for connecting said housing to said rotary actuator means.

4. An apparatus, as claimed in claim 1, wherein:

said rotary table means includes thrust bearing means for accepting axial and radial loads that are applied to said rotary table means.

5. An apparatus, as claimed in claim 1, wherein:

said rotary shaft of said rotary actuator means and said piston of said cylinder are spaced from each other and are separated wherein there is no direct engagement between said shaft and said piston.

6. An apparatus, as claimed in claim 1, wherein:

said cylinder means includes plate means for connecting said rotary table means to said cylinder means in a selected one of said two positions.

7. An apparatus, as claimed in claim 1, wherein:

said rotary actuator means has one cylinder having a cylindrical casing with a rack and piston being movable relative to said casing and said rack and piston adapted to move using pressurized air in a selected one of two opposite directions.

8. An apparatus, as claimed in claim 1, wherein:

said rotary actuator includes two cylinders, each of said two cylinders including a cylindrical casing and having a rack and piston and hydraulic oil being disposed in at least one of the two cylindrical casings during operation of the apparatus.

9. An apparatus, as claimed in claim 8, wherein:

said rotary actuator means includes a reservoir body for containing fluid that is a separate unit but connectable to end portions of said two cylinders.

10. A multi-axis apparatus, comprising:

rotary actuator means for providing rotary motion, said actuator means comprising:

two cylinders, each of said cylinder including a cylindrical casing and having a rack and piston with fluid being disposed in at least one of the two cylindrical casings during operation of the apparatus; and reservoir means for containing said fluid, said reservoir means joined to end portions of said two cylinders;

cylinder means for linear motion including a linearly movable piston and a cylinder body, wherein said cylinder means by itself is not able to rotate; and rotary table means connecting said rotary actuator means and said cylinder means for coupling said rotary motion of said rotary actuator means to said cylinder means, wherein substantially all of said cylinder means including said piston and said cylinder body rotate.

11. An apparatus, as claimed in claim 10, wherein:

said reservoir means is a substantially completely enclosed unit and includes fluid level detecting means for providing an indication as to the amount of fluid in said reservoir means.

12. An apparatus, as claimed in claim 11, wherein said fluid detecting means includes:

spring means for biasing said detecting means in a preselected direction, said spring means having portions contained within said reservoir means; and indicator means operably connected to said spring means for providing an indication as to the level of fluid.

13. An apparatus, as claimed in claim 12, wherein:

said spring means includes a plunger with an attached piston and a coiled spring surrounding said plunger with said plunger being movable relative to said reservoir means as said fluid level decreases.

14. An apparatus, as claimed in claim 13, wherein:

said indicator means includes a pull ring connected to said plunger.

15. An apparatus, as claimed in claim 10, wherein:

said reservoir means includes a reservoir body having a first cylinder passageway and a second cylinder passageway, wherein each of said first and second cylinder passageways has an outlet end that is contiguously adjacent to one of said cylindrical casings.

16. An apparatus, as claimed in claim 15, wherein:

said reservoir means includes a common passageway for interconnecting said first and second cylinder passageways to provide a fluid path between said first and second cylinder passageways.

17. An apparatus, as claimed in claim 16, wherein:

said reservoir means includes first and second cartridge means for flow control, said first cartridge means being operatively associated with said first cylinder passageway for controlling fluid movement in said first cylinder passageway and said second cartridge means operatively associated with said second cylinder passageway for controlling fluid movement in said second cylinder passageway.

18. An apparatus, as claimed in claim 10, wherein:

said reservoir means includes a reservoir body having a reservoir chamber formed therein for housing fluid, said reservoir means also including a reservoir port for providing fluid from said reservoir chamber.

19. A modular multi-axis apparatus, comprising:

rotary actuator means for providing rotary motion;

cylinder means for providing linear motion including a linearly movable piston wherein said cylinder means by itself is not capable of rotation; and rotary table means for interconnecting said rotary actuator means and said cylinder means, said cylinder means being connected to said rotary table means in a selected one of at least two positions, wherein a longitudinal axis of said cylinder means is substantially 90° different in said two positions while said rotary actuator means remains in a same orientation for each of said two positions of said cylinder means.

* * * * *